United States Patent [19]

Kaiwa et al.

[11] Patent Number: 4,670,633

[45] Date of Patent: Jun. 2, 1987

[54] KEYBOARD ASSEMBLY WITH LIGHTING

[75] Inventors: Ryoichi Kaiwa, Yokohama; Yuichiro Suganuma, Yokosuka; Takeo Yasuho, Neyagawa, all of Japan

[73] Assignee: Matsushita Electric Industrial Co., Ltd., Osaka, Japan

[21] Appl. No.: 662,905

[22] Filed: Oct. 19, 1984

[30] Foreign Application Priority Data

Oct. 19, 1983 [JP] Japan ..... 58-195647

[51] Int. Cl.[4] ..... H01H 9/18

[52] U.S. Cl. ..... 200/314; 200/DIG. 47; 200/313; 362/24

[58] Field of Search ..... 200/310, 313, 314, 317, 200/159 B; 362/23, 24, 26, 27, 29, 30

[56] References Cited

U.S. PATENT DOCUMENTS

| | | | |
|---|---|---|---|
| 2,711,711 | 6/1955 | Harman | 200/DIG. 47 |
| 3,144,643 | 8/1965 | Anderson | 200/314 X |
| 3,755,661 | 8/1973 | Bouvrande | 200/314 X |
| 4,088,855 | 5/1978 | Emery | 200/314 X |
| 4,124,879 | 11/1978 | Schoemer | 362/26 |
| 4,177,501 | 12/1979 | Karlin | 362/26 |
| 4,288,672 | 9/1981 | Puccini | 200/314 |
| 4,349,705 | 9/1982 | Kuhfus | 200/314 X |
| 4,439,646 | 3/1984 | Bouvrande | 200/314 X |
| 4,449,024 | 5/1984 | Stracener | 200/317 |
| 4,493,958 | 1/1985 | Hamilton et al. | 200/314 |

*Primary Examiner*—Stephen Marcus
*Assistant Examiner*—Ernest G. Cusick
*Attorney, Agent, or Firm*—Wenderoth, Lind & Ponack

[57] ABSTRACT

A keyboard capable of efficiently illuminating push buttons with a small number of light sources, wherein light sources are randomly distributed below a grating-like retainer provided for retaining push buttons of the keyboard and light rays from the light sources are reflected by means of pyramidal reflectors disposed above the light sources so as to illuminate a plurality of push buttons sideways and thereby efficiently illuminate a push button with light rays from light sources positioned along a plurality of directions.

15 Claims, 6 Drawing Figures

KEYBOARD ASSEMBLY WITH LIGHTING

BACKGROUND OF THE INVENTION

1. Field of Invention:

The present invention relates to a keyboard provided with an illuminating device for push buttons.

2. Background of Invention:

FIGS. 1(A) and 1(B) are views for showing the structure of a conventional keyboard, the former being a plan view and the latter a sectional view thereof. In the drawings, the reference numerals 1, 2, and 3 indicate a front case of the keyboard, push buttons each bearing a numeral or the like on the surface thereof, and light sources, for example, LEDS (light emitting diodes), respectively.

The numerals 4 and 5 indicate a mechanical switch and a printed circuit substrate for transmitting ON- or OFF-signal emitted by the mechanical switch 4, respectively. The mechanical switch 5 is formed of a bent stainless steel sheet which is fixed to the substrate and, when depressed with sufficient pressure by the push button 2, it is deformed into another configuration to perform a switching operation by mechanical contact.

In the conventional structure as described above, when this kind of keyboard is used at night or in a dark place, a light source 3 located below the push buttons is turned on to enable an operator to read markings on the push buttons and discriminate button 2 from the others. A push button used for the structure described above is a molded product made of a translucent material, for example, acrylic resin, which has a disadvantage in that a spot which is brightly illuminated by the light source is on a limited part of the push button 2 and uneven brightness appear on the surface of the button, thereby causing the indicated marking to be illegible. For improving uneven illumination, the provision of a light source for each button or at the periphery of the button is required, which disadvantageously results in an increase in the number of light sources and power consumption for illumination. Further, for improvement of uneven brightness, there has been a method of reducing loss in light transmission by providing a light guide made of transparent acrylic resin and the like, however, because of a necessity to provide a light guide in addition to the frame retaining the push buttons, this method has been followed by drawbacks such as an increase in the number of parts and resultant difficulty in handling the keyboard.

An object of the present invention is to provide a keyboard capable of brightly illuminating push buttons with a small number of light sources.

Another object of the present invention is to make it possible to illuminate a plurality of push buttons more uniformly.

Still another object of the present invention is to reduce the number of light sources through the application of light reflection from pyramidal reflectors which results in less power consumption for the light sources.

A further object of the present invention is to provide a keyboard in which illumination is made more even by the provision of second wedge-like reflectors.

DESCRIPTION OF THE PREFERRED EMBODIMENTS:

The present invention provides a structure comprising a plurality of translucent push buttons, switches each disposed below each of said push buttons and actuated with said push button depressed, a retainer for retaining said push buttons, light sources randomly distributed below said retainer, and pyramidal reflectors lying opposite to said light sources and disposed on said retainer, wherein the light rays from said light sources are reflected by said reflectors for illuminating a plurality of said push buttons from the sides thereof.

DESCRIPTION OF THE PREFERRED EMBODIMENT

Figure 1A:
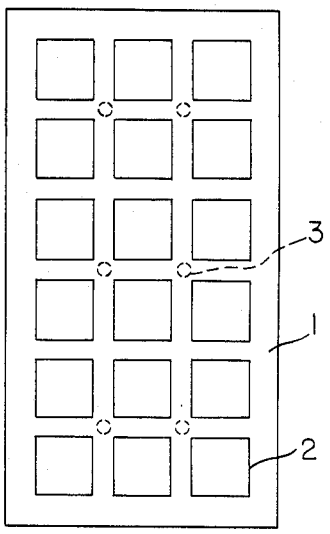
FIG. 1A PRIOR ART
FIGS. 1(A) and 1(B) are a plan and a sectional view, respectively, of the structure of a keyboard hitherto used.
Figure 1B:
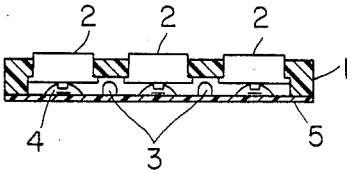
FIG. 1B PRIOR ART
Figure 2:
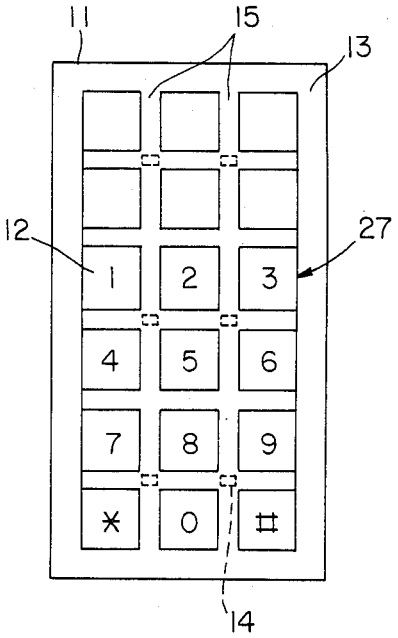
FIG. 2 is a plan view of a keyboard as an embodiment of the present invention.
Figure 3:
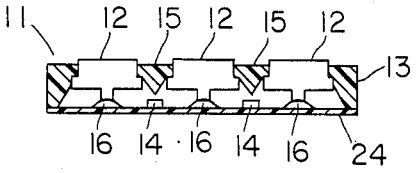
FIG. 3 is a sectional view thereof.
Figure 4:
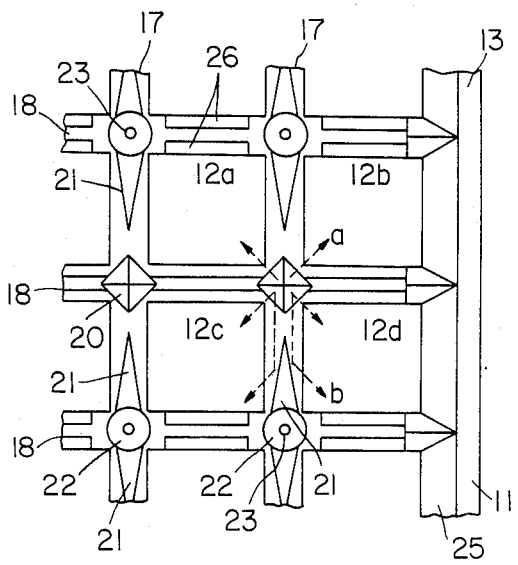
FIG. 4 is a plan view of a separator used therein.
Figure 5:
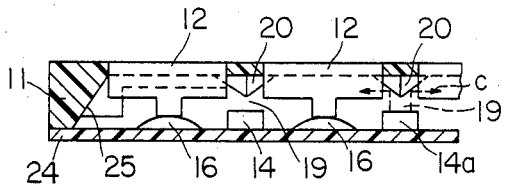
FIG. 5 is a sectional view of a main part thereof.

The structure of an embodiment of the present invention will be described with reference to the drawings. FIG. 2 is a plan view of a keyboard, in which the reference numeral 11 indicates a front case of the keyboard; 12, square plate-like translucent push buttons; 13, a frame of the front case; 14, light sources such as LEDs provided below push buttons 12 for illuminating said push buttons 12; 15, a separator for separating push buttons from each other and arranging them longitudinally and transversely to form retaining parts for retaining push buttons 12; and 16, switches actuated when the push buttons are depressed. FIG. 3 is a cross-sectional view of the front case 11 of the keyboard. FIG. 4 is a plan view showing the detail of the structure of the separator 15, in which the numerals 17 and 18 indicate longitudinal and transverse frames, respectively, of the separator 15, and, at a junction of both frames 17 and 18, a square pyramidal reflector 20 is provided opposite to the light source 14 with a small intertice 19 defined therebetween as shown in FIG. 5 illustrating a cross-sectional view. At another junction, a setting part 22 is provided having two wedge-like projections 21 extending in two directions opposite to each other and a screw-threaded hole 23 is provided for fixing the separator 15 to the printed circuit substrate 24 by means of a screw (not shown). The numerals 25 and 26 indicate an oblique part of the frame 11 and an edge for retaining the push button 12, respectively. The separator 15 including square pyramidal reflectors 20 and setting parts 22 is composed of an integrally molded product made of, for example, milky white plastic material.

In FIGS. 4 and 5, the light rays outwardly emitted by one **14*a* of light sources 14 all of which act in the same manner but the operation of only one light source 14*a* being explained for the sake of simplicity are reflected by the oblique surfaces of the square pyramidal reflector 20 as shown by lines a in FIG. 4 and lines c in FIG. 5 and illuminate the sides of push buttons 12*a* through 12*d* disposed adjacent to the reflectors in a matrix pattern. On the other hand, some other parts of the light rays are reflected by the oblique surfaces of the square pyramidal reflector 20 and then illuminate the push buttons 12*c* and 12*d* after being reflected by the sides of the wedge-like projections 21 (2nd reflectors) as shown by lines b. Further, the oblique side 25 of the frame 13 of the front case 11 acts as a reflector plate. The material of the separator 15 may be plated with a light reflecting coating for reflecting the light rays. The switch 16 may be the same in structure and function as those described earlier or it may be replaced by another type of pressure-sensitive switch. The push button 12 is made of a transparent plastic material or a translucent material which passes light to some degree and is adapted to bear a character such as a numeral engraved on the surface thereof, or is designated by one of the characters individually printed on a separate sheet represented generally by 27 in FIG. 2 which is stuck to the keyboard surface to cover all of the push buttons. FIG. 3 shows the keyboard of the present invention with the sheet 27** removed therefrom.

When using LEDs as light sources, it is possible to use a light emitting diode unit in which two LEDs emitting light beams different in color from each other are disposed in one position so that the color of emitted light is different according to operation of a push button.

What is claimed is:

1. A keyboard assembly comprising:

a support surface;

a plurality of switches disposed on said support surface in a matrix pattern;

a plurality of push buttons, each of which is disposed above a respective one of said plurality of switches;

a grating-like retainer disposed above said support surface and having a plurality of apertures therein, each of which receives one of said plurality of push buttons, said push buttons having sides which extend below a bottom surface of each retainer;

a plurality of light sources disposed between said retainer and said support surface; and a plurality of square pyramidal reflectors, each of which has a square base and a plurality of flat reflecting surfaces which extend from said base and meet at an apex, said apex disposed a small distance above a respective one of said plurality of light sources, each of said flat reflecting surfaces being adjacent to at least one side of one of said plurality of push buttons whereby light rays from said plurality of light sources are reflected from said plurality of flat surfaces to said sides of said plurality of push buttons for illumination thereof.

2. The keyboard assembly of claim 1, wherein said retainer comprises longitudinal and transverse frame members which intersect at junctions, each of said plurality of pyramidal reflectors being disposed on one of said junctions.

3. The keyboard assembly of claim 1, wherein said retainer and said plurality of pyramidal reflectors are formed into a one-piece body.

4. The keyboard assembly of claim 1, further comprising a plurality of wedge-like projections having flat surfaces for reflecting light rays which are reflected from said plurality of pyramidal reflectors, each one of said plurality of wedge-like projections being disposed between adjacent push buttons.

5. The keyboard assembly of claim 1, wherein said light sources are light emitting diodes (LEDs).

6. The keyboard assembly of claim 5, wherein each one of said plurality of light sources is a light emitting diode unit which comprises a plurality of light emitting diodes, each of which emits light of a different color, the color of light emitted from the light emitting diode unit being controlled by operation of one of said plurality of push buttons.

7. The keyboard assembly of claim 1, wherein said retainer has outer frame members which are disposed on said support surface and define a space between a lower surface of said retainer which receives said plurality of push buttons and said support surface, said outer frame members having oblique internal reflecting surfaces facing said space.

8. The keyboard assembly of claim 1, wherein said retainer has a lower surface facing said support surface, said lower surface being plated with a light reflecting coating.

9. The keyboard assembly of claim 1, wherein each one of said plurality of switches comprises a deformed elastic metal sheet.

10. The keyboard assembly of claim 1, wherein each one of said plurality of switches comprises a pressure sensitive switch.

11. The keyboard assembly of claim 1, wherein each one of said plurality of push buttons is formed of a plastic material.

12. The keyboard assembly of claim 1, wherein each one of said plurality of pyramidal reflectors is made of a plastic material.

13. The keyboard assembly of claim 1, wherein said plurality of pyramidal reflectors are white in colors.

14. The keyboard assembly of claim 1, further comprising a sheet having individual characters printed thereon disposed on said retainer to cover at least some of said plurality of push buttons.

15. The keyboard assembly of claim 2, wherein a plurality of setting parts having screw-threaded holes therein are disposed between said retainer and said support surface at said junctions which do not have pyramidal reflectors thereat.

* * * * *